US007626486B2

(12) United States Patent
Miura et al.

(10) Patent No.: US 7,626,486 B2
(45) Date of Patent: Dec. 1, 2009

(54) VARIABLE RESISTOR AND METHOD OF MANUFACTURING THE SAME

(75) Inventors: Seiki Miura, Okayama (JP); Takumi Nishimoto, Okayama (JP)

(73) Assignee: Panasonic Corporation, Osaka (JP)

( * ) Notice: Subject to any disclaimer, the term of this patent is extended or adjusted under 35 U.S.C. 154(b) by 491 days.

(21) Appl. No.: 11/529,040

(22) Filed: Sep. 28, 2006

(65) Prior Publication Data

US 2007/0080774 A1 Apr. 12, 2007

(30) Foreign Application Priority Data

Oct. 6, 2005 (JP) ..... 2005-293574

(51) Int. Cl.
*H01C 10/32* (2006.01)

(52) U.S. Cl. ..... 338/162

(58) Field of Classification Search ..... 338/162
See application file for complete search history.

(56) References Cited

U.S. PATENT DOCUMENTS 3,768,157 A * 10/1973 Buie ..... 438/116
5,631,623 A * 5/1997 Yoshimura ..... 338/142
6,201,228 B1 3/2001 Yoshida
6,275,140 B1 8/2001 Asano
6,483,421 B1 * 11/2002 Eichelmann ..... 338/162

FOREIGN PATENT DOCUMENTS

CN 1253363 A 5/2000
CN 1259746 A 7/2000
JP 2003-124008 4/2003

* cited by examiner

*Primary Examiner*—Elvin G Enad
*Assistant Examiner*—Joselito Baisa
(74) *Attorney, Agent, or Firm*—RatnerPrestia

(57) ABSTRACT

A variable resistor includes a resistor element having a first end and a second end, a slider sliding on the resistor element, an adjustable resistor portion having a first end connected to the first end of the resistor element and having a second end, a first terminal connected to the second end of the adjustable resistor portion, a second terminal electrically coupled to the second end of the resistor element, and a third terminal connected to the slider. The adjustable resistor portion is positioned outside of the sliding range of the slider. This variable resistor outputs a precise resistance having s small variation from a predetermined resistance.

15 Claims, 6 Drawing Sheets

VARIABLE RESISTOR AND METHOD OF MANUFACTURING THE SAME

FIELD OF THE INVENTION

The present invention relates to a variable resistor used for operating various devices, and to a method of manufacturing the variable resistor.

BACKGROUND OF THE INVENTION

As electronic devices, such as car air-conditioners, have recently had high performance, variable resistors is demanded to be capable of providing precise resistance output used for operating of the devices.

FIG. 8 is a sectional view of conventional rotary variable resistor 5001. FIG. 9 is an exploded perspective view of variable resistor 5001. Resistor board 1 includes an insulating substrate made of laminated substrate made of paper phenol resin or glass epoxy resin having circular hole 1A formed in the center thereof. Resistor element 92 having a C-shape is provided on a top surface of resistor board 1 at an outer periphery of board 1. Conductor 3 having a ring shape is provided on the top surface and inside the C-shape of resistor element 92. Resistor element 92 and conductor 3 are formed by, for example, screen printing. Both ends of resistor element 2 and conductor 3 are electrically connected to terminals 4A, 4B, and 4C, respectively. Terminals 4A, 4B and 4C are fixed to resistor board 1. Insulating case 5 made of insulating resin has an upper opening having a circular shape. Case 5 has hole 5A having a size and a position substantially identical to those of engaging hole 1A is formed in the center of the circular shape of the upper opening. Resistor board 1 is formed by insert molding so that resistor element 2 and conductor 3 expose on an inner bottom surface of the opening in insulating case 5. Terminals 4A, 4B, and 4C project outward from a side wall of plate portion 5B extending from the side wall of insulating case 5. Rotating body 6 has through-hole 6A having an oblong shape provided in the central portion thereof Rotating body 6 has flange 6B having a dusk shape in the upper portion of body 6, and shaft 6C having a cylindrical shape in the lower portion of body 6. Slider 7 is fixed to a bottom surface of flange 6B. Slider 7 slides on and contact resistor element 2 and conductor 3 provided on resistor board 1. Shaft 6C having the cylindrical shape is inserted in hole 1A of resistor board 1 and engaging hole 5A of insulating case 5 which overlap each other. Shaft 6C has a thin tip. The tip is formed to have a trumpet shape on the bottom surface of insulating case 5 and attached rotatably to the bottom surface of case 5.

An operation of rotary variable resistor 5001 will be described below. A rotation operator is inserted in through-hole 6A through rotating body 6 having a substantially oblong shape. When rotating body 6 rotates, slider 7 fixed to the bottom surface of flange 6B slides on resistor element 92 and conductor 3 provided on resistor board 1. A resistance in response to a position at which slider 7 contacts resistor element 2 is obtained from terminals 4A, 4B, and 4C.

Conventional rotary variable resistor 5001 may output a resistance varying from a predetermined resistance due to variations of resistor element 2 printed on resistor board 1 or displacement of components.

Conventional variable resistor 5001 may reduce production yield rate of devices, such as vehicle-mounted devices, and audio visual devices, which require a precise resistance, and raises their production cost.

SUMMARY OF THE INVENTION

A variable resistor includes a resistor element having a first end and a second end, a slider sliding on the resistor element, an adjustable resistor portion having a first end connected to the first end of the resistor element and having a second end, a first terminal connected to the second end of the adjustable resistor portion, a second terminal electrically coupled to the second end of the resistor element, and a third terminal connected to the slider. The adjustable resistor portion is positioned outside of the sliding range of the slider.

This variable resistor outputs a precise resistance having s small variation from a predetermined resistance.

DETAILED DESCRIPTION OF THE PREFERRED EMBODIMENT

Figure 1:
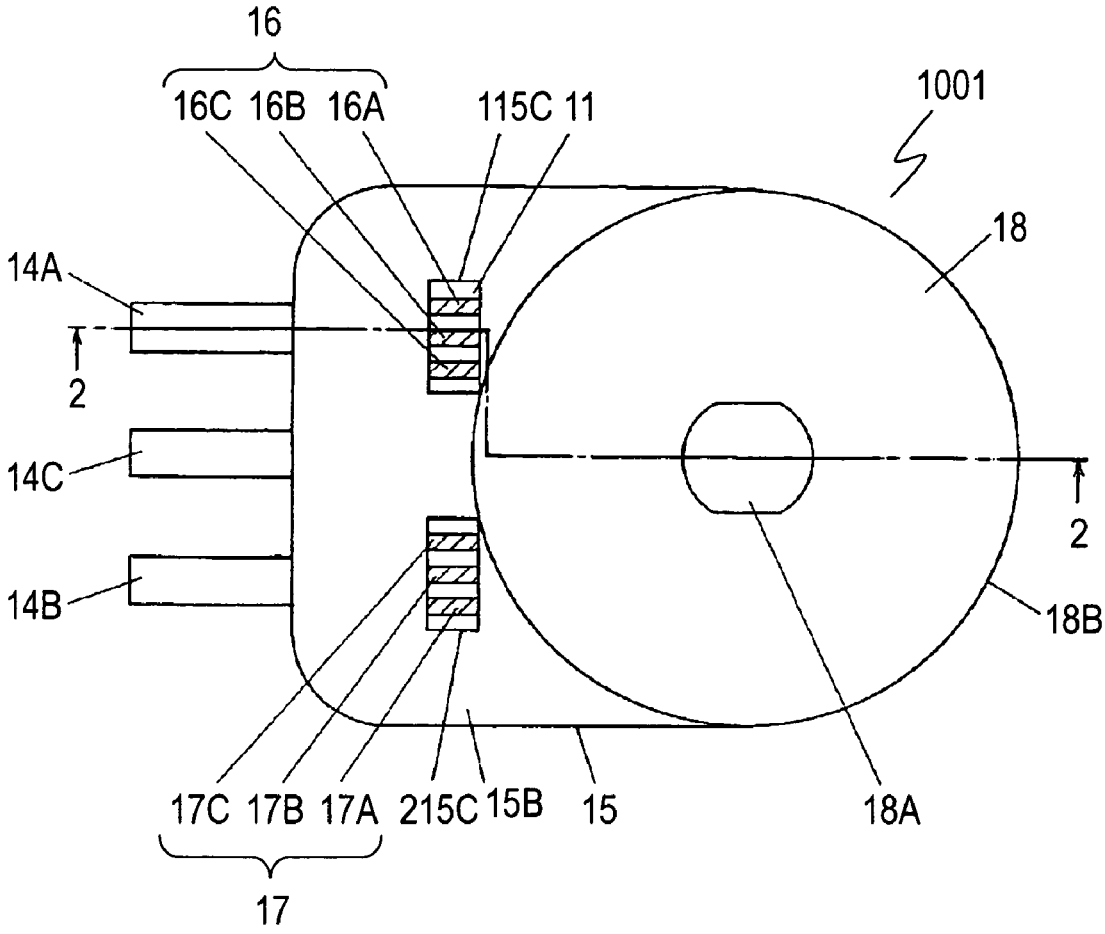
FIG. 1 is a plan view of a variable resistor in accordance with an exemplary embodiment of the present invention.
Figure 2:
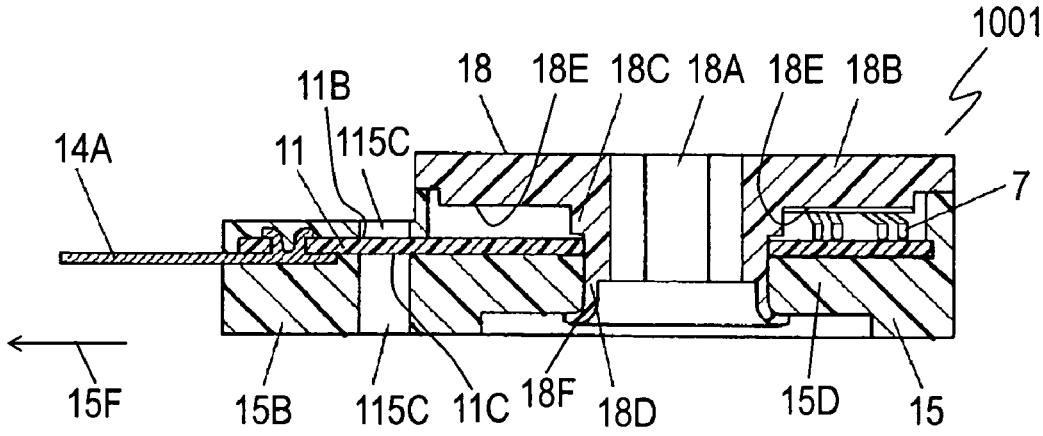
FIG. 2 is a sectional view of the variable resistor at line 2-2 shown in FIG. 1.
Figure 3:
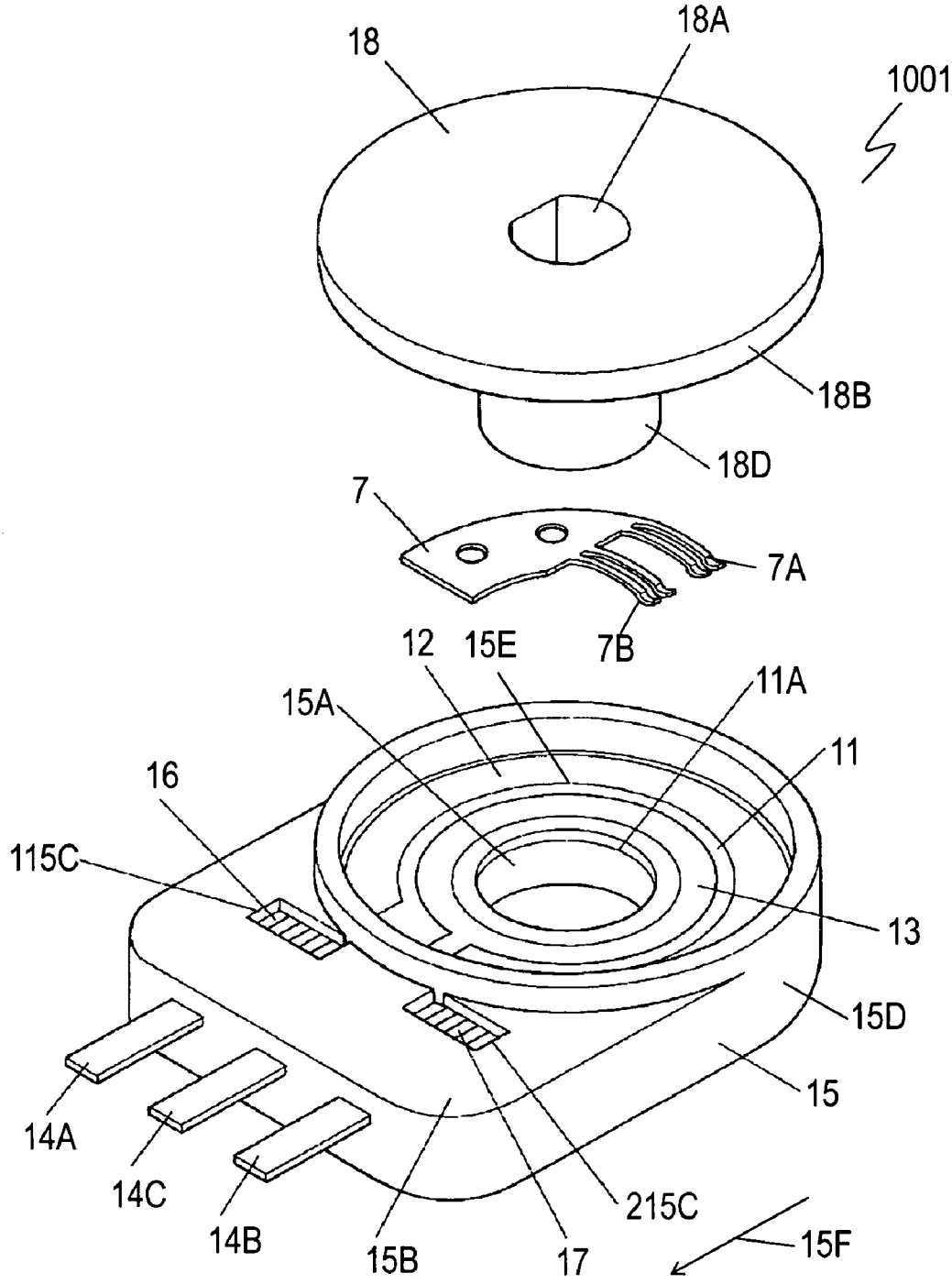
FIG. 3 is an exploded perspective view of the variable resistor in accordance with the embodiment.
Figure 4:
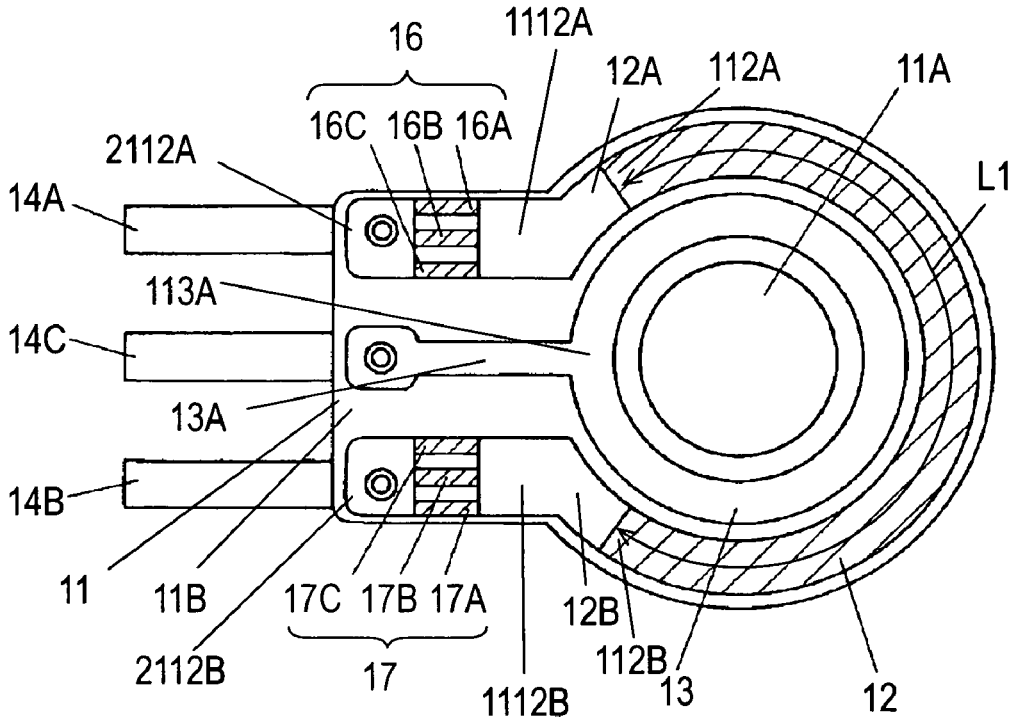
FIG. 4 is a plan view of a resistor board of the variable resistor in accordance with the embodiment.

FIG. 1 is a plan view of rotary variable resistor 1001 in accordance with an exemplary embodiment of the present invention. FIG. 2 is a sectional view of variable resistor 1001 at line 2-2 shown in FIG. 1. FIG. 3 is an exploded perspective view of variable resistor 1001. FIG. 4 is a plan view of resistor board 11 of variable resistor 1001.

Resistor board 11 made of insulating resin has circular through-hole 11A in the center thereof. Conductor 13 and resistor element 12 are formed on top surface 11B of board 11 by screen printing. Conductor 13 is shaped in a ring concentric with circular through-hole 11A. Resistor element 12 has substantially a C-shape concentric with circular through-hole 11A at an outer periphery of conductor 13.

Resistor element 12 has both ends 112A and 112B. Conductor 13 has portion 113A. Leads 12A, 12B, and 13A are connected to ends 112A, 112B, and 113A, and extend outward from resistor board 11 from ends 112A and 112B and portion 113A, respectively. Terminals 14A, 14B, and 14C are fixed to an end of resistor board 1. Leads 12A, 12B, and 13A are connected to terminals 14A, 14B, and 14C, respectively.

Lead 12A is provided between end 112A of resistor element 12 and terminal 14A. Lead 12A includes conductor 1112A connected to end 112A, conductor 2112A connected to terminal 14A, and adjustable resistor portion 16 that is provided between conductors 1112A and 2112A and that is connected to conductors 1112A and 2112A. Adjustable resistor portion 16 is connected in series with resistor element 12. Adjustable resistor portion 16 includes three auxiliary resistor portions 16A, 16B, and 16C connected between conductors 1112A and 2112A in parallel with each other. Auxiliary resistor portions 16A, 16B, and 16C are formed on top surface 11B of resistor board 11 equidistant from one another by screen printing. In other words, conductor 1112A serves as an end of adjustable resistor portion 16 that is connected to end 112A of resistor element 2. Conductor 2112A serves as an end of adjustable resistor portion 16 that is connected to terminal 14A. Terminal 14A is electrically coupled to end 112A of resistor element 12.

Similarly to above, lead 12B is provided between end 112B of resistor element 12 and terminal 14B. Lead 12B includes conductor 1112B connected to end 112B, conductor 2112B connected to terminal 14B, and adjustable resistor portion 17 that is provided between conductors 1112B and 2112B and that is connected to conductors 1112B and 2112B. Adjustable resistor portion 17 is connected in series with resistor element 12. Adjustable resistor portion 17 includes three auxiliary resistor portions 17A, 17B, and 17C connected between conductors 1112B and 2112B in parallel with one another. Auxiliary resistor portions 17A, 17B, and 17C are formed on top surface 11B of resistor board 11 equidistant from one another by screen printing. In other words, conductor 1112B serves as an end of adjustable resistor portion 17 that is connected to end 112B of resistor element 2. Conductor 2112B serves as an end of adjustable resistor portion 17 that is connected to terminal 14B. Terminal 14B is electrically coupled to end 112B of resistor element 12.

Insulating case 15 has circular opening 15E allowing resistor element 12 and conductor 13 to expose through opening 15E, and is formed by insert-molding resistor board 11 with insulating resin. Engaging hole 15A is formed in bottom surface 15D of insulating case 15. Hole 15A has a size and a position identical to those of circular through-hole 11A formed in resistor board 11. Engaging hole 15A is concentric with circular opening 15E. Insulating case 15 has plate portion 15B extending in lateral direction 15F. Terminals 14A, 14B, and 14C project outward from plate portion 15B in lateral direction 15F. Insulating case 15 holds resistor element 12 via resistor board 11. Holes 115C and 215C having rectangular shapes are formed in plate portion 15B at positions corresponding to adjustable resistor portions 16 and 17, respectively. Adjustable resistor portions 16 and 17 formed on resistor board 11 exposes from holes 115C and 215C, respectively. Auxiliary resistor portions 16A to 16C exposes from hole 115C so as to be contacted from the outside of insulating case 15. Similarly, auxiliary resistor portions 17A to 17C exposes from holes 215C so as to be contacted from the outside of insulating case 15. Each of holes 115C and 215C is provided on top and bottom surfaces of resistor board 11. Thus, holes 115C and 215*c* penetrate through plate portion 15B of insulating case 15. Instead of holes 115C and 215C, six holes which allows auxiliary resistor portions 16A to 16C and 17A to 17C to expose, respectively, may be formed in insulating case 15.

Through-hole 18A having a substantially oblong shape is formed in the center of rotating body 18. Flange 18B having a disk shape is provided at the upper portion of rotating body 18 so as to cover opening 15E of insulating case 15. Slider 7 made of resilient conductive material is provided on bottom surface 18E of flange 18B facing opening 15E. Slider 7 has portion 7A operable to slide on resistor element 12 and portion 7B operable to slide on conductor 13. Sliding range L1 which slider 7 (portion 7A) slides on is resistor element 12. Rotating body 18 includes accepter 18C of a cylindrical shape located below flange 18B, and shaft 18D provided at the tip of accepter 18C and having a diameter smaller than that of accepter 18C. Shaft 18D is inserted into circular through-hole 11A provided in resistor board 11 and in engaging hole 15A provided in insulating case 15 overlapping through-hole 11A. Tip 18F of shaft 18D is expanded on the bottom surface of insulating case 15 and attached rotatably to insulating case 15.

An operation of rotating variable resistor 1001 will be described below. A rotation operator is inserted into through-hole 18A in rotating body 18. Upon rotating body 18 rotating, portions 7A and 7B of slider 7 slide on resistor element 12 and conductor 13, respectively. A resistance between terminals 14A and 14C and a resistance between terminals 14B and 14C change according to the angle at which rotating body 18 rotates, i.e. to the position of slider 7. Slider 7 does not slide on adjustable resistor portion 16 or adjustable resistor portion 17. Adjustable resistor portions 16 and 17 are positioned outside of sliding range L1 of slider 7.

Figure 5:
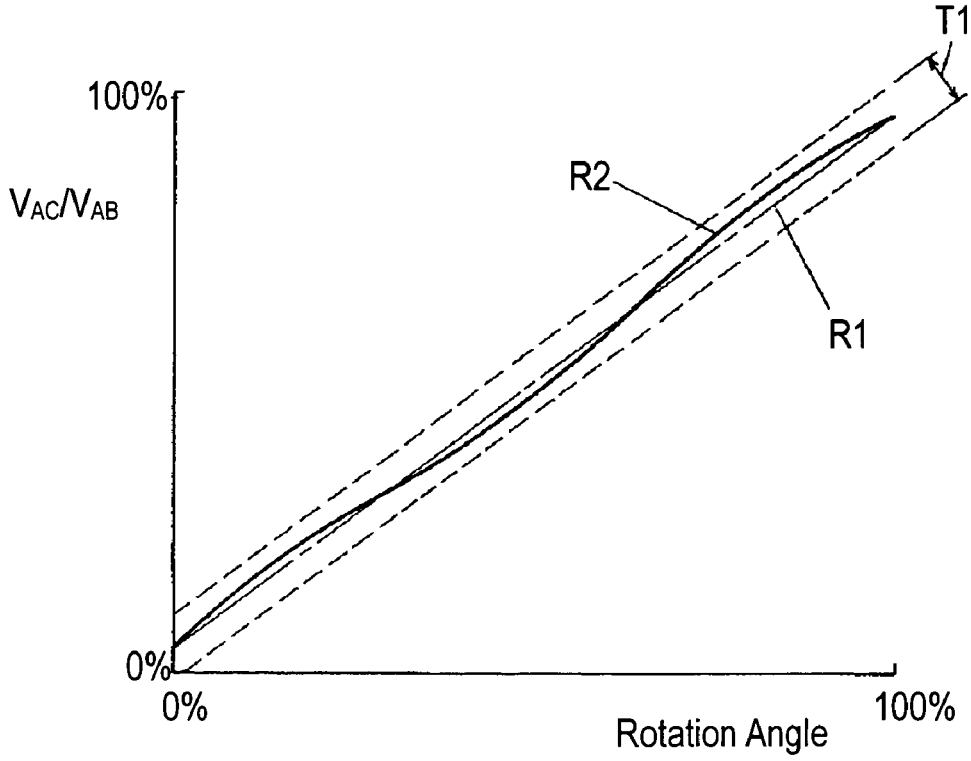
FIG. 5 shows a change of a resistance of the variable resistor in accordance with the embodiment.

A method of adjusting a resistance of rotating variable resistor 1001 with using adjustable resistor portions 16 and 17 will be described below. FIG. 5 shows a change of the resistance between terminals 14A and 14B. Predetermined voltage $V_{AB}$ is applied between terminals 14A and 14B, and voltage $V_{AC}$ is measured between terminals 14A and 14C. The ratio $V_{AC}/V_{AB}$ of the measured voltage to the predetermined voltage indicates the change of the resistance indirectly. In FIG. 5, the horizontal axis represents an angle (rotation angle) at which rotating body 18 rotates, and the vertical axis represents the voltage ratio $V_{AC}/V_{AB}$. The rotation angle is expressed as the ratio to a full scale. Desired characteristic R1 is a desired characteristic of the change of the resistance of variable resistor 1001. Measured characteristic R2 is the characteristic actually measured. Variable resistor 1001 has tolerance T1 between lines in parallel with desired characteristic R1. The voltages between terminals 14A, 14B, and 14C are measured in order to indirectly detect the resistance between at least two of these terminals changing according to the position of slider 7 (portion 7A).

If measured characteristic R2 is within tolerance T1, as shown in FIG. 5, it is not necessary to adjust adjustable resistor portions 16 and 17. If measured characteristic R2 is not within tolerance T1 due to displacement caused by variations or combinations of components, at least one of auxiliary resistor portions 16A to 16C of adjustable resistor portion 16 is left, and the remaining auxiliary resistor portions is disconnected so as to put measured characteristic R2 within tolerance T1

Figure 6:
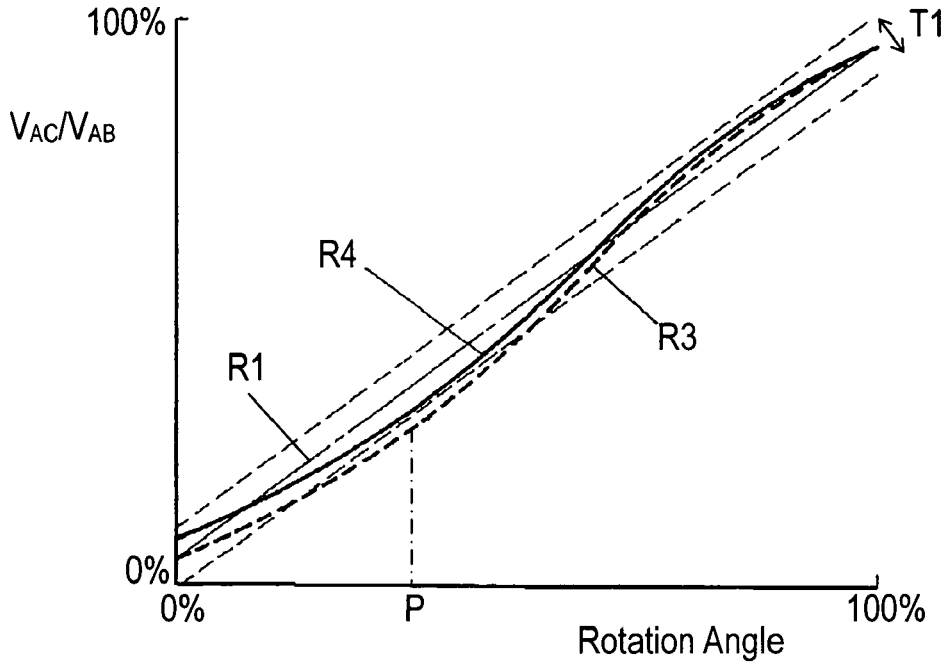
FIG. 6 shows a change of the resistance of the variable resistor in accordance with the embodiment.

FIG. 6 shows a change of the resistance of variable resistor 1001. Measured characteristic R3 deviates from tolerance T1 at angle P closer to a rotation angle of 0% than to a rotation angle of 100%. In this case, auxiliary resistor portion 16A of adjustable resistor portion 16 is punched for electrical disconnection so as to increase the resistance of adjustable resistor portion 16 from that before the disconnection of auxiliary resistor portion 16A. While voltage ratios at angles close to the rotation angle of 100% are almost unchanged, voltage ratios at angles close to the rotation angle of 0% increase. This operation phenomenon causes measured characteristic R3 to shift upward in the left side of FIG. 6, and allows measured characteristic R3 of variable resistor 1001 to be adjusted to characteristic R4 provided within tolerance T1.

Figure 7:
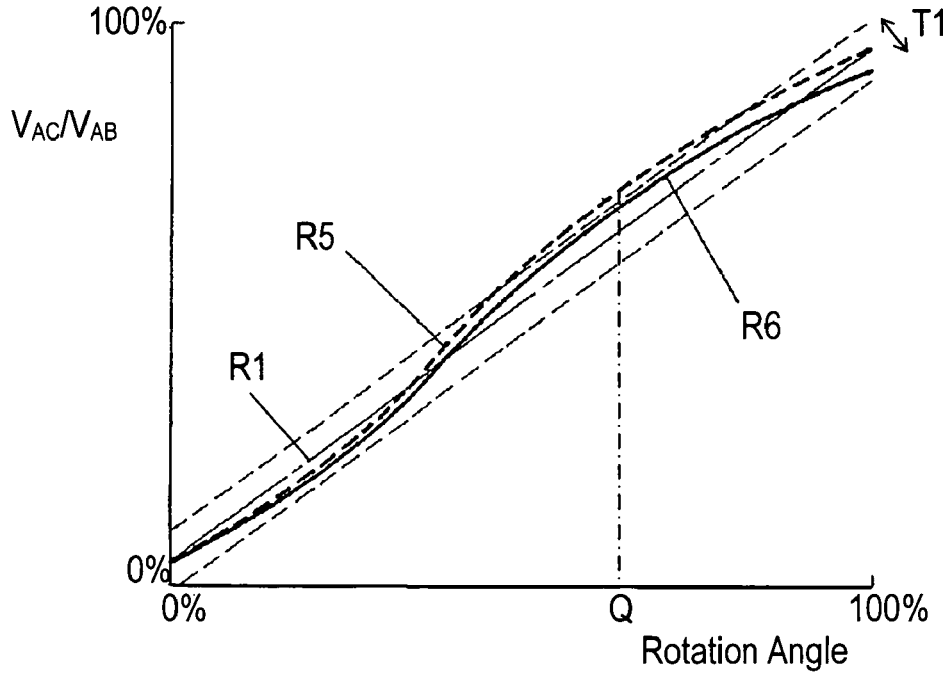
FIG. 7 shows a change of the resistance of the variable resistor in accordance with the embodiment.
Figure 8:
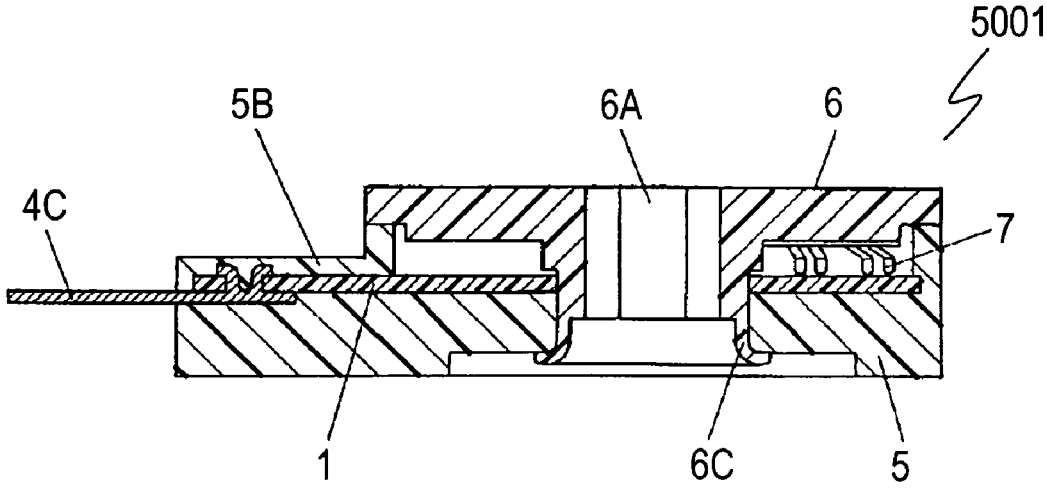
FIG. 8 is a sectional view of a conventional variable resistor.
Figure 9:
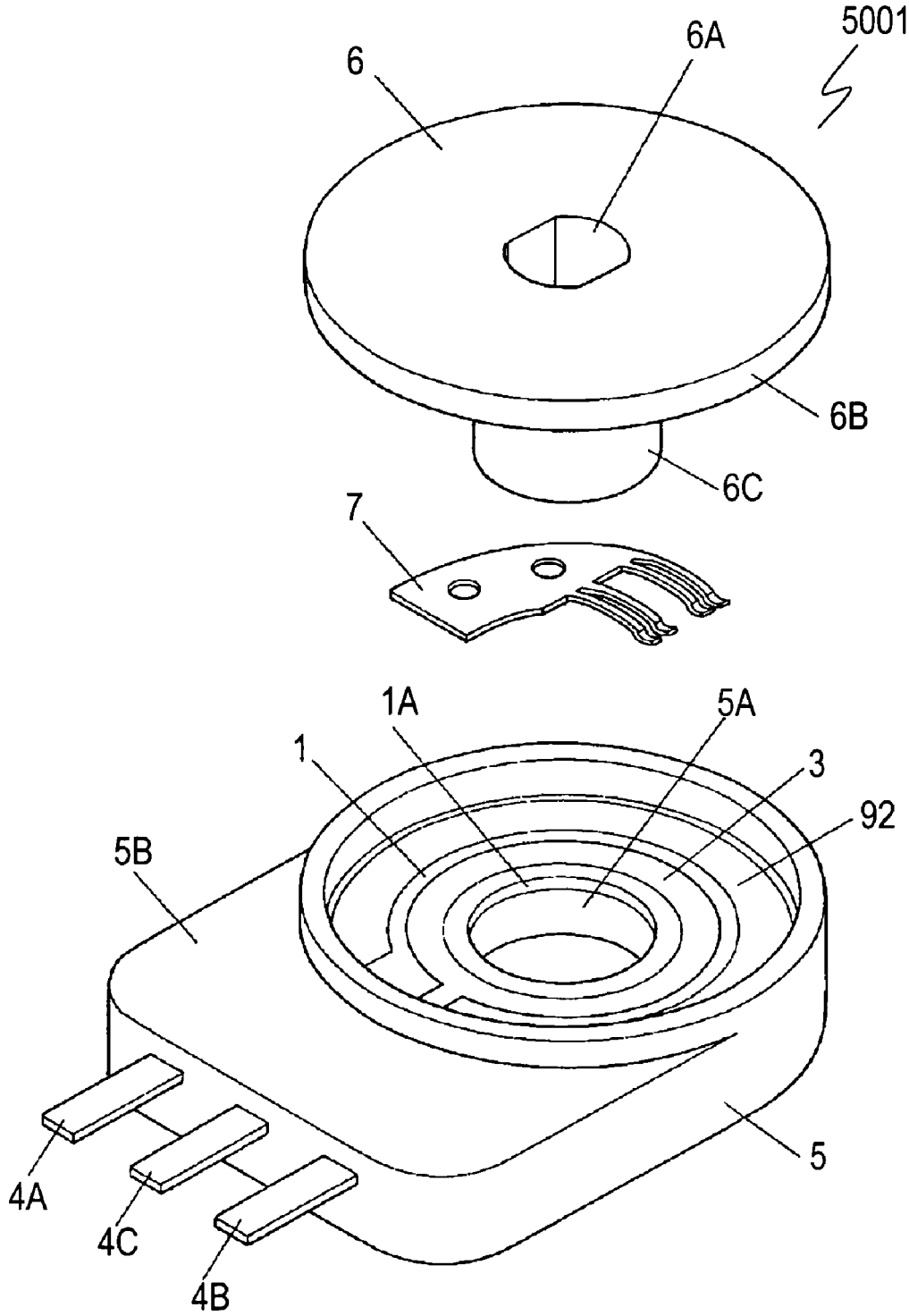
FIG. 9 is an exploded perspective view of the conventional variable resistor.

FIG. 7 shows a change of the resistance of variable resistor 1001. Measured characteristic R5 deviates from tolerance T1 at angle Q closer to the rotation angle of 100% than to the rotation angle of 0%. In this case, auxiliary resistor portion 17A of adjustable resistor portion 17 is punched for electrical disconnection so as to increase the resistance of adjustable resistor portion 17 from that before the disconnection of auxiliary resistor portion 17A. While voltage ratios at angles close to the rotation angle of 0% are almost unchanged, voltages ratios at angles close to the rotation angle of 100% increase. This operation causes measured characteristic R5 to shift downward in the right side of FIG. 7, and allows measured characteristic R5 of variable resistor 1001 to be adjusted to characteristics R6 provided within tolerance T1.

Variable resistor 1001 has holes 115C and 215C each of which are provided on both the top and bottom surfaces of resistor board 11. In other words, holes 115C and 215C penetrate through insulating case 15. This structure allows adjustable resistor portions 16 and 17 to be easily punched. Insulating case 15 covers resistor board 11 around holes 115C and 215C, hence preventing resistor board 11 from damage due to the punching of adjustable resistor portions 16 and 17.

As described above, in variable resistor 1001 of this embodiment, auxiliary resistor portions 16A to 16C and 17A to 17C of adjustable resistor portions 16 and 17 exposing from holes 115C and 215C, respectively, are punched to allowing the change of the resistance of the variable resistor to be adjusted after the assembling of the variable resistor.

Adjustable resistor portions 16 and 17 connected to ends 112A and 112B of resistor element 12 enables the change of the resistance at angles close to the rotation angle of 0, and the change of the resistance at angles close to the rotation angle of 100% to be adjusted separately. Thus, variable resistor 1001 has a wide adjustable range of the change of its resistance. The variable resistor according to the embodiment may have only one of adjustable resistor portions 16 and 17, having the change of its resistance adjustable even after being completed.

According to this embodiment, adjustable resistor portion 16 includes three auxiliary resistor portions 16A to 16C connected in parallel with each other. Adjustable resistor portion 17 includes three auxiliary resistor portions 17A to 17C connected in parallel with each other. The number of the auxiliary resistor portions is not limited to three. Their resistances may be determined appropriately to the resistance of variable resistor 1001.

Holes 115C and 215C in insulating case 15 may be provided only on adjustable resistor portions 16 and 17, respectively, that is, only in surface 11B of resistor board 11. Insulating case 15 covers bottom surface 11C opposite to top surface 11B of resistor board 11. In this case, auxiliary resistor portions 16A to 16C and 17A to 17C are trimmed by, for example, laser, so as to increase the resistances of adjustable resistor portions 16 and 17.

Variable resistor 1001 according to this embodiment is a rotary variable resistor. However, a sliding variable resistor including a resistor element and adjustable resistor portions provided at both ends of the resistor element can provide the same effects.

What is claimed is:

1. A variable resistor comprising:

a resistor element having a first end and a second end;

a slider operable to slide on the resistor element, the slider having a sliding range which the slider slides on, a first end of the sliding range positioned at the first end of the resistor element and the second end of the sliding range positioned at the second end of the resistor element;

a conductor element having a first end and a second end, the second end of the conductor element connected to the first end of the resistor element;

a first adjustable resistor portion having a first end and a second end, the first end of the first adjustable resistor portion being connected to the first end of the conductor element, the first adjustable resistor portion being positioned outside of the sliding range of the slider;

a first terminal connected to the second end of the first adjustable resistor portion;

a second terminal electrically coupled to the second end of the resistor element; and a third terminal connected to the slider.

2. The variable resistor of claim 1, wherein the first adjustable resistor portion includes a plurality of auxiliary resistor portions.

3. The variable resistor of claim 2, wherein the plurality of auxiliary resistor portions are connected in parallel with each other.

4. The variable resistor of claim 1, further comprising a second adjustable resistor portion having a first end and a second end, the first end of the second adjustable resistor portion being connected to the second end of the resistor element, the second end of the second adjustable resistor portion being connected to the second terminal, the second adjustable resistor portion being positioned outside of the sliding range of the slider.

5. The variable resistor of claim 4, wherein the second adjustable resistor portion includes a plurality of auxiliary resistor portions.

6. The variable resistor of claim 5, wherein the plurality of auxiliary resistor portions are connected in parallel with each other.

7. The variable resistor of claim 1, further comprising an insulating case for holding the resistor element, the insulating case having a hole formed therein to allow the first adjustable resistor portion to expose from the hole so as to allow the first adjustable resistor portion to be contacted from outside of the insulating case.

8. The variable resistor of claim 7, wherein the hole penetrates through the insulating case.

9. The variable resistor of claim 1, further comprising a rotating body for causing the slider to slide.

10. A method of manufacturing a variable resistor comprising:

providing a resistor element having a first end and a second end;

providing a slider for sliding on the resistor element, the slider having a sliding range which the slider slides on, a first end of the sliding range positioned at the first end of the resistor element and the second end of the sliding range positioned at the second end of the resistor element;

providing a conductor element having a first end and a second end, the second end of the conductor element connected to the first end of the resistor element;

providing a first adjustable resistor portion having a first end and a second end, the first end of the first adjustable resistor portion being connected to the first end of the conductor element, the first adjustable resistor portion being positioned outside of the sliding range of the slider;

providing a first terminal connected to the second end of the first adjustable resistor portion;

providing a second terminal electrically coupled to the second end of the resistor element;

providing a third terminal connected to the slider;

after said providing the first adjustable resistor portion, detecting a change according to a position of the slider of a resistance between at least two of the first terminal, the second terminal, and the third terminal; and adjusting a resistance of the first adjustable resistor portion based on the detected change.

11. The method of claim 10, wherein said providing the first adjustable resistor portion comprises providing a plurality of auxiliary resistor portions connected between the first end of the resistor element and the first terminal, and wherein said adjusting the resistance of the first adjustable resistor portion comprises disconnecting at least one of the plurality of auxiliary resistor portions.

12. The method of claim 10, further comprising providing a second adjustable resistor portion having a first end and a second end, the first end of the second adjustable resistor portion being connected to the second end of the resistor element, the second end of the second adjustable resistor portion being connected to the second terminal, the second adjustable resistor portion being positioned outside of the sliding range of the slider, wherein said detecting the change of the resistance comprises, after said providing the first adjustable resistor portion and said providing the second adjustable resistor portion, detecting the change according to the position of the slider of the resistance between said at least two of the first terminal, the second terminal, and the third terminal.

13. The method of claim 12, further comprising adjusting a resistance of the second adjustable resistor portion based on the detected change.

14. The method of claim 12, wherein said providing the second adjustable resistor portion comprises providing a plurality of auxiliary resistor portions connected between the second end of the resistor element and the second terminal, and wherein said adjusting the resistance of the second adjustable resistor portion comprises disconnecting at least one of the plurality of auxiliary resistor portions.

15. The variable resistor of claim 1, wherein, when the slider is positioned at a first end of the sliding range, a resistance measured between the first terminal and the third terminal is substantially equal to a resistance of the first adjustable resistor.

* * * * *